US005411401A

United States Patent [19]

Chiou

[11] Patent Number: 5,411,401

[45] Date of Patent: May 2, 1995

[54] STRUCTURE OF ELECTRICAL CONNECTOR

[75] Inventor: Charles Chiou, Taipai, Taiwan, Prov. of China

[73] Assignee: Silitek Corporation, Taipei, Taiwan, Prov. of China

[21] Appl. No.: 207,470

[22] Filed: Mar. 8, 1994

[51] Int. Cl.[6] ..... H01R 13/627

[52] U.S. Cl. ..... 439/76; 439/359; 439/362; 439/638

[58] Field of Search ..... 439/76, 638, 362, 359, 439/639

[56] References Cited

U.S. PATENT DOCUMENTS

| | | | |
|---|---|---|---|
| 4,290,664 | 9/1981 | Davis et al. | 439/638 X |
| 4,934,950 | 6/1990 | Green et al. | 439/362 X |
| 5,158,474 | 10/1992 | Frantz | 439/362 X |
| 5,197,900 | 3/1993 | Ellis et al. | 439/359 X |
| 5,213,532 | 5/1993 | Mee | 439/359 X |

*Primary Examiner*—Larry I. Schwartz
*Assistant Examiner*—Daniel Wittels
*Attorney, Agent, or Firm*—Browdy and Neimark

[57] ABSTRACT

An electrical connector includes a bottom shell, a cover shell covered on the bottom shell, a PC board mounted within the bottom and cover shell and having a male connector extended out of the bottom and cover shells, and two fasteners mounted on respective mounting blocks on the bottom and cover shells at two opposite sides to fasten the male connector of the PC board to a respective parallel port on the computer, wherein each fastener consists of a rotary driving roller mounted on the mounting blocks at either side and having wings for turning by hand, a bolt driven into a respective screw hole on the computer by the rotary driving roller, and a spring received in a polygonal hole on the rear end of the bolt and supported on the rotary driving roller.

2 Claims, 4 Drawing Sheets

STRUCTURE OF ELECTRICAL CONNECTOR

BACKGROUND OF THE INVENTION

The present invention relates to an electrical connector for a computer system which can be conveniently installed in the mainframe of a computer through screw joints without the use of any screw driver. The most important idea is that the set of this electrical connector can save more space than other types at present. It provides the space enough for users to use two connectors side by side without interfering.

The connector for a computer peripheral equipment is commonly fastened to the respective port on the back side of the mainframe of a computer by screws. Conventionally, the screws of the connector must be turned by a screw driver. Now, the screws of the connector are made having a respective elongated head for turning by hand. However, because the COM1 port and parallel port on the mainframe of a computer are disposed in parallel there is not sufficient space between the two ports. It is still not easy to mount a computer peripheral equipment to the mainframe.

SUMMARY OF THE INVENTION

The present invention has been accomplished under the aforesaid circumstances. One of the objects of the present invention is to provide an electrical connector for a computer system which can be conveniently installed without the use of any tools. The main object of the present invention is to provide an improved electrical connector for a computer system by some special design. That is, this idea can let two connectors mounted on the parallel port and COM1 port of a computer mainframe at a time without affecting each other (This design will be detailed latter).

The present invention uses fasteners to fasten the electrical connector to a respective parallel port on the mainframe of a computer. The fastener consists of a rotary driving roller mounted on respective mounting blocks on the bottom and cover shells of the electrical connector at either side and having wings for turning by hand, a bolt driven by the rotary driving roller into a respective screw hole on the computer, and a spring received in a polygonal hole on the rear end of the bolt and supported on the rotary driving roller. When either wings of the rotary driving roller are vertically aligned, they do not project out of the bottom and cover shells of the electrical connector, and therefore the fasteners can be conveniently fastened to the mainframe of the computer by hand. When the computer is installed in a narrow area, a stick or like means may be used to push either wing of either rotary driving member causing it to turn the respective bolt into the respective screw hole on the mainframe of the computer.

DETAIL DESCRIPTION OF THE PREFERRED EMBODIMENT

Figure 1:
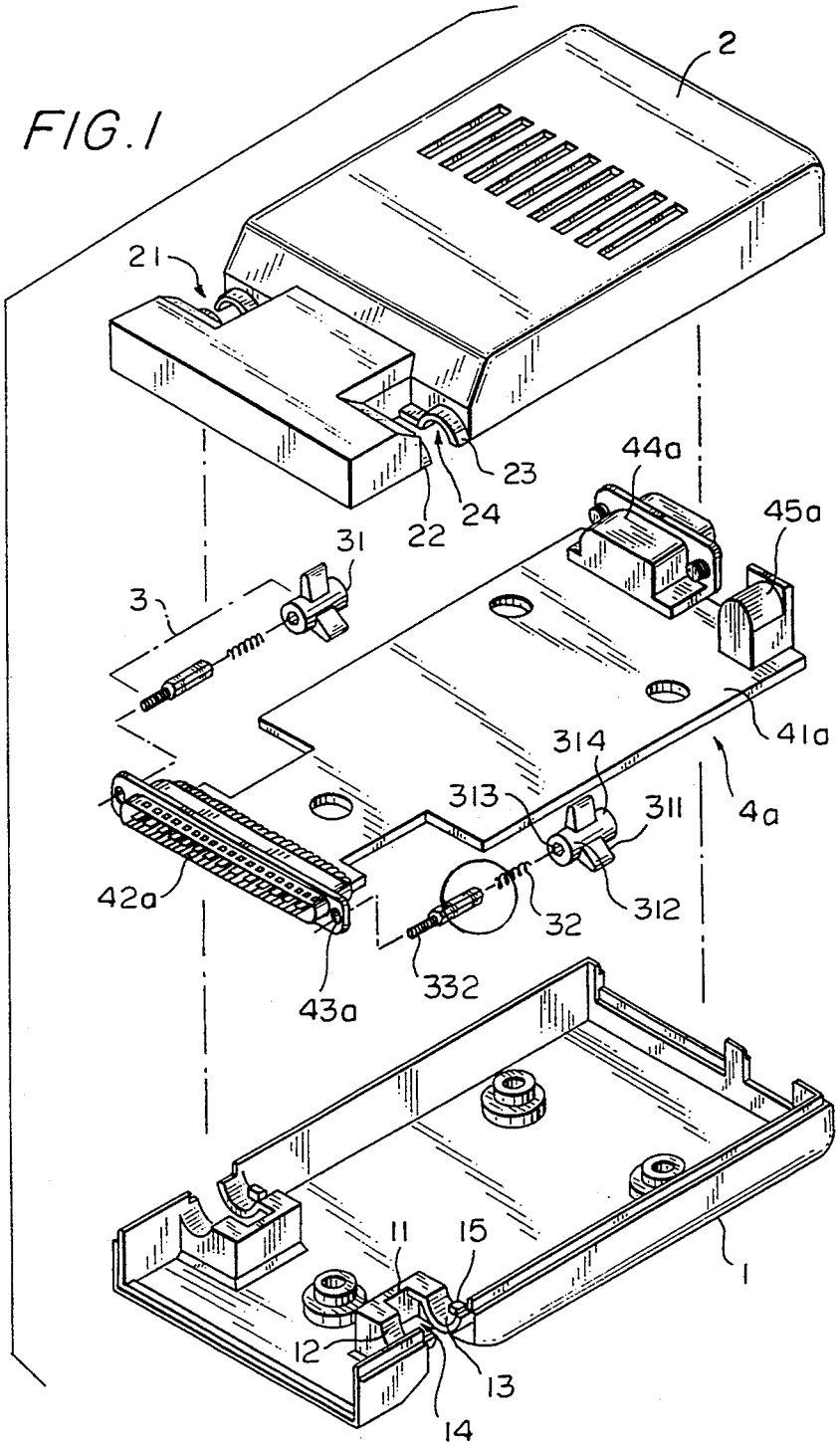
FIG. 1 is an exploded view of the electrical connector according to the preferred embodiment of the present invention.
Figure 1A:
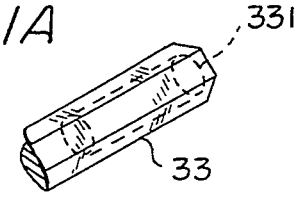
FIG. 1A is an enlarged view of the circled area of FIG. 1.
Figure 2:
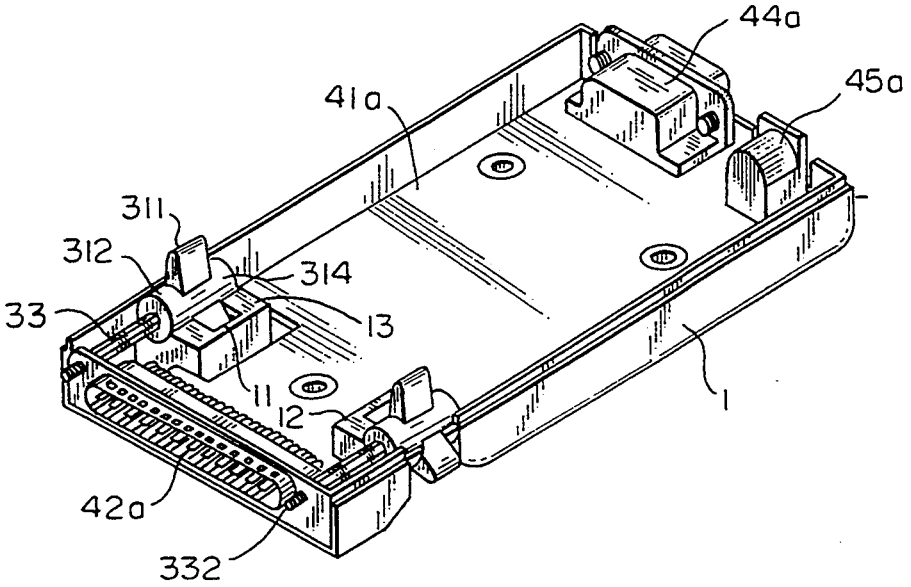
FIG. 2 shows the PC board on the bottom shell thereof and the fasteners fastened to the male connector of the PC board.
Figure 3:
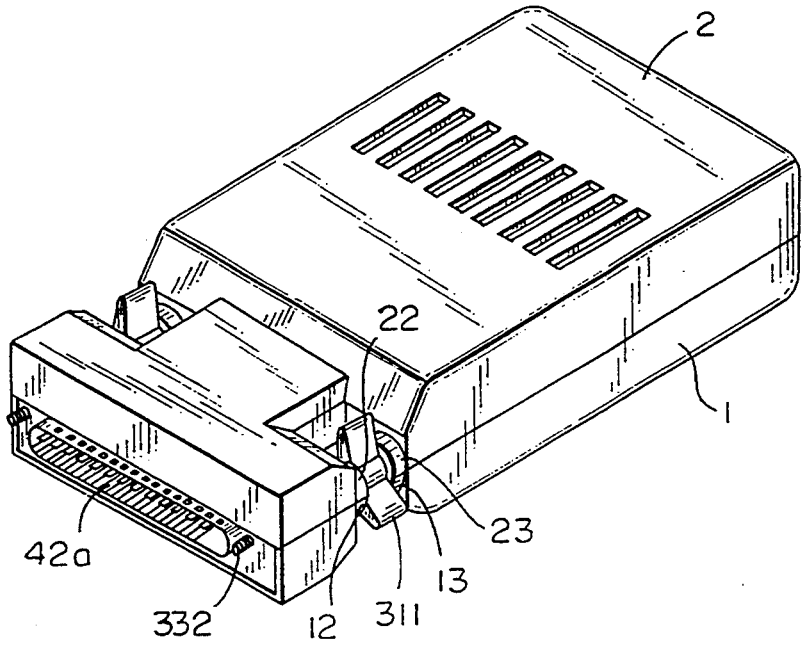
FIG. 3 is an elevational view of the electrical connector.
Figure 4:
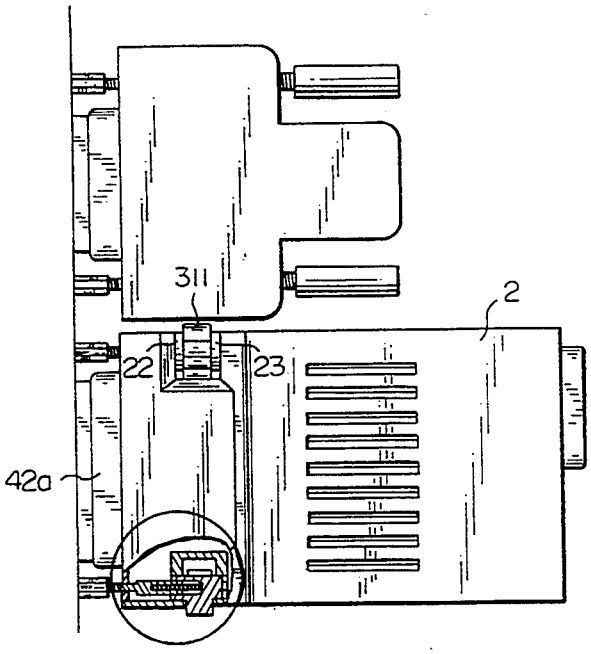
FIG. 4 is a plain view showing the electrical connector of the present invention mounted on the parallel port of the mainframe of a computer, and the relationship between the other connector.
Figure 4A:
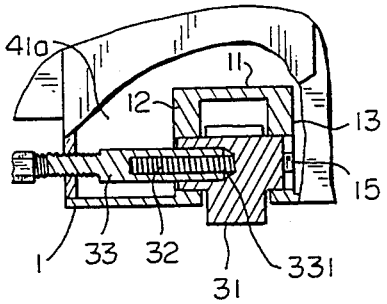
FIG. 4A is an enlarged view of the circled area of FIG. 4.
Figure 4B:
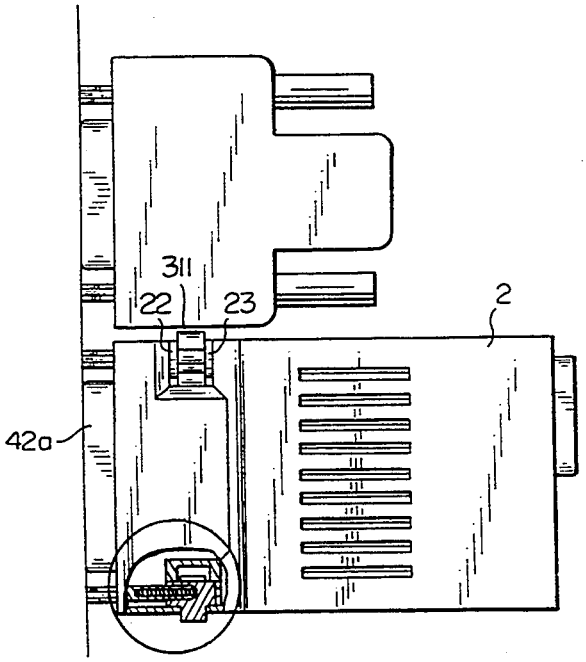
FIG. 4B is a plain view showing an alternate embodiment of the electrical connector of the present invention mounted on the parallel port of the mainframe of a computer, and the relationship between the other connecter.
Figure 4C:
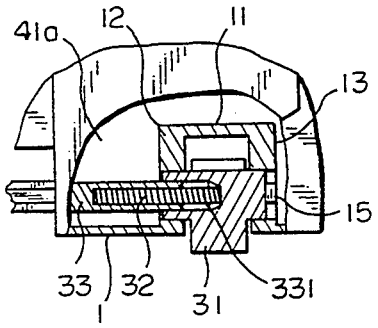
FIG. 4C is an enlarged view of the circled area of FIG. 4B.
Figure 5A:
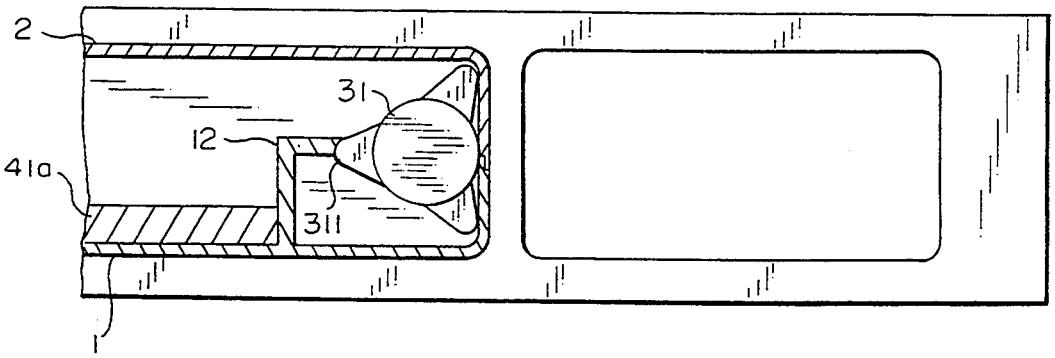
FIGS. 5A and 5B are back views showing the position of this connector mounted on the parallel port of computer's mainframe.
Figure 5:
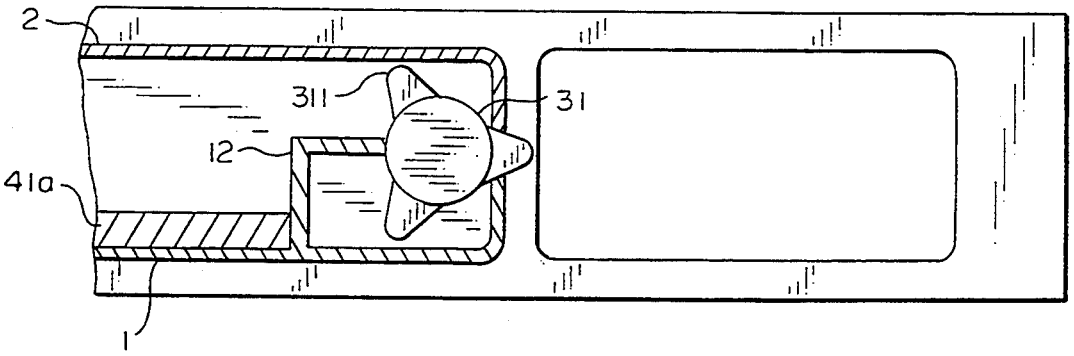

Referring to FIGS. 1 and 1A, an electrical connector in accordance with the preferred embodiment of the present invention is generally comprised of a bottom shell 1, a cover shell 2, two fasteners 3, and a PC board assembly 4*a*.

The bottom shell 1 comprises two mounting blocks 11 bilaterally disposed at the top near the front side thereof, each mounting block 11 having two circularly recessed arms 12, 13 spaced by an opening 14 and a stop rib 15 raised from one recessed arm 13.

The cover shell 2 comprises two mounting blocks 21 bilaterally disposed at the bottom and fitting over the mounting blocks 11 on the bottom shell 1 respectively, each mounting block 21 having two circularly recessed arms 22; 23 spaced by an opening 24.

The fastener 3 is comprised of a rotary driving roller 31, a spring 32, and a bolt 33. The rotary driving roller 31 comprises a plurality of wings 341 equally spaced in the middle around a circle and disposed in either opening 14 on the bottom shell 1, a front axle 312 supported on the circularly recessed front arm 12 of either mounting block 11 on the bottom shell 1 and having a polygonal center hole 313, and a rear axle 314 supported on the circularly recessed rear arm 13 of the same mounting block 11 on the bottom shell 1. The bolt 33 has one end terminating in a polygonal tube 331, which receives the spring 32 and fits into the polygonal center hole 313 on the rotary driving roller 31, and an opposite end terminating in a screw rod 332.

The PC board assembly 4*a* comprises a PC board 41*a*, a male connector 42*a* mounted on the PC board 41*a* at one end, a female connector 44*a* and a power socket 45*a* bilaterally mounted on the PC board 41*a* at an opposite end. The male connector 42*a* has two small round holes 43*a* on the casing at two opposite ends.

The assembly process of the electrical connector is easy and outlined hereinafter with reference to FIGS. 1, 1A, 2, and 3. The PC board assembly 4*a* is put in the bottom shell 1, then the two fasteners 3 are respectively mounted on the two mounting blocks 11 of the bottom shell 1 by loading the front and rear axles 312;314 on the respective arms 12;13 with the rear axle 314 of each rotary driving roller 31 stopped against the respective stop rod 15 and the wings 311 received in the respective opening 14, permitting the screw rod 332 of each bolt 33 to be inserted into either small round hole 43*a* on the male connector 42*a*, and then the cover shell 2 is fastened to the bottom shell 1 by screws and covered over the PC board assembly 4*a*.

Referring to FIGS. 4, 4A, 4B, 4C, 5 and 5B, when the male connector 42*a* is connected to the parallel port on the mainframe of a computer, the wings 311 of the rotary driving roller 31 of either fastener 3 is turned forwards causing the screw rod 332 threaded into a respective screw hole on the parallel port. When wings 311 of the rotary driving roller 31 are vertically aligned, they do not project out of the periphery of the bottom and cover shells 1;2, (see FIG. 5A), so make use of the rotary driving roller's shape (especially the wings' shape), we can get more space than other products when mount this connector, then, the surplus space can prevent affecting another connector which is mounted on COM1 (usually for mounting an optical mouse).

While only one embodiment of the present invention has been shown and described, it will be understood that various modifications and changes could be made without departing from the spirit and scope of the invention.

What is claimed is:

1. An electrical connector comprising:

a bottom shell having two mounting blocks bilaterally disposed at a top near a front side thereof, each mounting block having a front circularly recessed arm and a rear circularly recessed arm spaced by an opening and a stop rib raised from the rear circularly recessed arm;

a cover shell covered on said bottom shell and having two mounting block bilaterally disposed at a bottom and fitting over the mounting blocks on said bottom shell respectively, each mounting block of said cover shell comprising two circularly recessed arms spaced by an opening;

a PC board received within said cover shell and said bottom shell and having a male connector with two opposite mounting holes for connecting to a parallel port on a mainframe of a computer;

two fasteners respectively mounted on the mounting blocks of said bottom shell and said cover shell for fastening the male connector of said PC board to the parallel port on the mainframe of the computer, each fastener comprising of a rotary driving roller, a spring, and a bolt, said rotary driving roller comprising a plurality of wings equally spaced around a circle and disposed in the openings on the mounting blocks on said bottom shell and said cover shell at a said side, a front axle supported on the circularly recessed front arms of the respective mounting blocks and having a polygonal center hole, and a rear axle supported on the circularly recessed rear arms of the respective mounting blocks, said bolt having a rear end terminating in a polygonal tube inserted into the polygonal center hole on said front axle and a front end terminating in a screw rod inserted through either mounting hole on the male connector of said PC board and driven by said rotary driving roller into a respective screw hole on the mainframe of the computer, said spring being received in said polygonal tube to support said bolt on said rotary driving roller.

2. The electrical connector of claim 1 wherein when either two wings of said rotary driving roller are vertically aligned, the wings of said rotary driving roller do not project out of said bottom shell and said cover shell.

* * * * *